US007802515B2

(12) United States Patent
Suetsugu

(10) Patent No.: US 7,802,515 B2
(45) Date of Patent: Sep. 28, 2010

(54) DRAWER-TYPE HEATING COOKER

(75) Inventor: Yumiko Suetsugu, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 47 days.

(21) Appl. No.: 11/947,305

(22) Filed: Nov. 29, 2007

(65) Prior Publication Data

US 2009/0140622 A1 Jun. 4, 2009

(51) Int. Cl.
*A47J 37/00* (2006.01)

(52) U.S. Cl. ..... 99/344; 99/342

(58) Field of Classification Search ..... 99/326–333, 99/337–340, 348, 400–401, 444–450, 467–479, 99/342–344; 219/400–401, 386, 411, 494–497; 126/21 A, 21 R, 41 R
See application file for complete search history.

(56) References Cited

U.S. PATENT DOCUMENTS

| | | | | |
|---|---|---|---|---|
| 6,730,882 | B2 * | 5/2004 | Atkinson | 219/413 |
| 7,308,852 | B2 * | 12/2007 | Kaminaka et al. | 99/476 |
| 7,328,654 | B2 * | 2/2008 | Shei | 99/468 |
| 7,329,838 | B2 * | 2/2008 | Song et al. | 219/400 |
| 7,363,923 | B2 * | 4/2008 | Czajka et al. | 126/39 B |

FOREIGN PATENT DOCUMENTS

| | | | |
|---|---|---|---|
| JP | 3-45820 | A | 2/1991 |
| JP | 8-175746 | A | 7/1996 |
| JP | 9-101796 | A | 4/1997 |
| JP | 11-237053 | A | 8/1999 |
| JP | 2000-249349 | A | 9/2000 |
| JP | 2006-038300 | A | 2/2006 |
| JP | 2008064353 | A * | 3/2008 |

* cited by examiner

*Primary Examiner*—Timothy F. Simone
(74) *Attorney, Agent, or Firm*—Birch, Stewart, Kolasch & Birch, LLP

(57) ABSTRACT

A drawer-type heating cooker capable of preventing, during an opening/closing operation of an automatic opening and closing door, a danger, such as being hit by the opening and closing door that is opening, or a hand or finger being get stuck in the opening and closing door that is closing, by calling attention to the opening and closing door movement, is provided. A drawer body allowing a heated object to be placed therein can be pulled out together with a door from a cooker body. In a state in which the drawer body is housed in the cooker body, an opening of a heating chamber is closed by the door. During opening/closing of the door, a warning sound is generated from a speaker provided in the cooker body or the door. For the warning sound, various settings such as the pitch, the tone and the volume can be made according to, for example, the open distance of the door detected by sensors. The warning sound calls attention from a person operating the heating cooker and people around the heating cooker so as to avoid a person or thing from being hit by the door that is opening, and from being get stuck in the door that is closing.

6 Claims, 7 Drawing Sheets

EXAMPLE SCORES CORRESPONDING TO UNIT MELODIES [A01] AND [B01]

DRAWER-TYPE HEATING COOKER

The present application is based on Japanese patent application No. 2006-240678 filed on Sep. 5, 2006, the entire contents of which are hereby incorporated by reference.

BACKGROUND OF THE INVENTION

1. Field of the Invention

The present invention relates to a drawer-type heating cooker capable of pulling out and pushing a drawer body from and into a cooker body, an opening portion of a heating chamber being able to be closed by an opening and closing door in a state in which the drawer body is housed.

2. Description of the Related Art

Conventionally, drawer-type heating cookers have been proposed, which allow a drawer body for placing a heated object therein to be pulled out from a cooker body together with an opening and closing door, and also allow an opening portion of a heating chamber in the cooker body to be closed by the opening and closing door in a pushed-in state in which the drawer body is housed in the heating chamber (Japanese Patent Laid-Open Publication No. 3-45820, page 2, lower left column, line 6 to page 3, upper right column, line 16, FIG. 1 to FIG. 5, [Patent Document 1]; and Japanese Patent Laid-Open Publication No. 11-237053, paragraphs [0029] to [0032] and FIG. 1 [Patent Document 2]). This kind of drawer-type heating cooker includes: an apparatus body (cooker body) having a cooking chamber (heating chamber) that accommodates a heated object; an opening and closing door that blocks the cooking chamber from external air; and a bottom plate or a heating container (drawer body) allowing the heated object to be placed therein which is connected to this opening and closing door. More specifically, the bottom plate or heating container slides smoothly by means of slide mechanisms, and as a result of the rotation output of a motor being transferred to the slide mechanism via a transfer means, such as a rack-and-pinion mechanism, the bottom plate or heating container can be moved in a direction that it is pulled out or pushed into the apparatus body. In a state in which the bottom plate or heating container is housed in the apparatus body, the opening and closing door blocks the cooking chamber from external air. In the heating cooker described in Patent Document 2, electric wave leakage is prevented by forming a heating chamber that confines microwaves therein by means of covering, with a lid portion, an opening in a heating container having the opening at its upper portion, the heating container being able to be pulled out from a cooker body, and providing a choke groove between the peripheral portion of the opening of the heating chamber and the lid portion.

As stated above, in a drawer-type heating cooker, food, which is a heated object, can easily be put in and taken out by making the drawer body connected to the door perform an electric opening/closing operation, and compared to conventional heating cookers in which a door is manually opened and closed, the drawer-type heating cooker provides superior convenience. However, conventionally, almost all of the household electric appliances installed in a kitchen, such as a refrigerator, a dishwasher, and a microwave oven, are opened/closed by their doors being opened/closed via a user's manipulation force, and users are not familiar with electric opening/closing operations, so considerations are necessary for safety.

For example, with the automatic opening and closing door mechanism in the above-mentioned conventional drawer-type heating cooker, a user that handles the cooker with being conscious of automatic opening/closing can expect the generation of an opening/closing operation, but people other than the user would encounter an unexpected opening/closing operation. Also, when the user himself/herself unconsciously performs an opening/closing operation, he/she would encounter an unexpected opening/closing operation.

In those cases, since the drawer body, which has a relatively large mass, is moved, a hand or finger or the like may be get stuck with the opening and closing door when the opening and closing door is closed, or a body portion may be hit by the opening and closing door without knowing the opening and closing door movement.

Also, necessary open distance and opening/closing speed for an opening and closing door differs depending on the use conditions, such as the installation position of the heating cooker, or the user's life style, or the properties of the heated object, such as the size of the heated object or the easiness of overflowing from the container, so there has been the demand for informing the user of the opening/closing operation conditions for the opening and closing door.

With regard to generating a warning sound when a pulling-out operation is performed, although the technical field is different, an image recording device that generates a pulling-out operation warning sound has been proposed (Japanese Patent Laid-Open Publication No. 8-175746, paragraph [0019] and FIG. 7 [Patent Document 3]). In other words, when an empty state of a hopper or a full state of a stacker, the hopper or stacker accommodating a recording material such as a recording paper, is detected, an operation for pulling the hopper or stacker out is performed, and at that time, a warning sound generation means, such as a buzzer, is activated to inform the operator of the respective state, and to call attention to the peripheral area of the hopper or stacker during the pulling-out operation.

With regard to a method for setting alarm sounds in a household electric apparatus, Japanese Patent Laid-Open Publication No. 9-101796 (Patent Document 4) proposes a technique for defining plural kinds of alarm sounds for plural apparatuses, the alarm sounds being able to be clearly distinguished from each other by providing sound elements that are different from each other, such as rhythm, tone scale or inflection, with the alarm sounds.

Accordingly, drawer-type heating cookers have a problem to be solved in calling attention to the operating and closing door movement from a person operating the automatic opening and closing door as well as other people around the drawer-type heating cooker during the operation of the opening and closing door.

SUMMARY OF THE INVENTION

An object of the present invention is to provide a drawer-type heating cooker capable of preventing, during an opening/closing operation of an automatic opening and closing door, a danger, such as being hit by the opening and closing door that is opening, or a hand or finger being get stuck in the opening and closing door that is closing, by calling attention to the opening and closing door movement from a person operating the opening/closing operation as well as people around the drawer-type heating cooker.

In order to achieve the above object, a drawer-type heating cooker according to the present invention provides a drawer-type heating cooker allowing a drawer body for placing a heated object therein to be pulled out from and pushed into a cooker body, an opening portion of a heating chamber being able to be closed by an opening and closing door in a pushed-in state, wherein sound settings are made to generate different warning sounds for an opening operation of the opening and closing door and a closing operation of the opening and closing door, and during the opening operation of the opening and closing door and the closing operation of the opening and closing door, the warning sound having the sound setting for the relevant operation is generated.

According to this drawer-type heating cooker, since the warning sound having the sound setting for the relevant operation is generated during the opening operation of the opening and closing door and the closing operation of the opening and closing door, the warning sound having the sound settings for a door opening operation is generated to call attention from people around the heating cooker during automatic opening of the opening and closing door, preventing a person or thing from being unexpectedly hit by the opening and closing door. Also, during automatic closing of the opening and closing door, attention is invited by the warning sound having the sound settings for a door closing operation so that a hand or figure, or a thing will not be get stuck in the opening and closing door that is closing, allowing the prevention of these accidents. Furthermore, when the opening and closing door moves as a result of unconsciously touching the door open or close key in the drawer-type heating cooker, people around the heating cooker can immediately recognize such an unexpected movement of the opening and closing door by means of the warning sound. Moreover, as a result of generating warning sounds suited to a user's taste by setting the sound during automatic opening and closing, the effect of drowning out unfavorable machine noises during the opening/closing of the drawer will be exerted.

In this drawer-type heating cooker, the settings for the warning sounds can be changed.

For example, if the sound settings for the warning sounds during automatic opening and closing are made so that their frequencies increase and decrease in contrast to each other, a user can easily distinguish the sounds. Also, if a modification or change is made to such contrastive sounds according to the properties of the heated object, such as the amount or calorific value, different impressions can be given to the user without losing the ease of distinguishing the warning sounds. For example, if it is difficult to catch high-frequency sounds, an easily-distinguishable warning sound contrast can be obtained by shifting the musical scale.

As an example of the warning sound change, the warning sounds can be changed according to the open distance of the opening and closing door. In other words, separate sound settings can be made according to whether the open distance of the opening and closing door is long or short. Furthermore, it is more preferable that example sound settings for door opening and closing are provided based on the above ease of distinguishing to enable a user to choose because settings not matching the user's senses, feelings or usage environments can be avoided.

In the drawer-type heating cooker in which the sound settings can be changed, the sound settings for the warning sounds can be determined according to the opening/closing speed during the opening operation of the opening and closing door and the closing operation of the opening and closing door. When the opening/closing speed of the opening and closing door is high, there is a high risk of the door hitting a person or thing, or a hand or finger or a thing being struck with the door. Accordingly, it is preferably that settings, such as acceleration of the sound frequency increase, or a gradual volume increase, are set to make the warning sounds have a higher warning ability as the opening/closing speed is higher. Conversely, when the opening/closing speed of the opening and closing door is low, it is preferable that the sound settings are made so that the warning sounds have a low warning ability.

Furthermore, the opening/closing speed of the opening and closing door can be set so that it can be changed according to a use condition of a user or a property of the heated object. In general, it is preferable that a heated object after being cooked is served before it gets cold, so quick door opening will be demanded when the user wants. When the user wants a relatively-quick operation, if the door opening operation is slow, the user may intervene in the door opening operation to manually speed up the door opening. As a result of that careless manipulation, there may be concerns such as the food spilling, so it is desirable that the opening door operation is accelerated. However, when the user does not want to handle a high-temperature food for serving, it is desirable that the door opens slowly.

For the properties of the heated object, for example, if the heated object is a liquid, a large amount of water vapors may be generated, so it is preferable to make the door opening speed slow. Furthermore, the liquid heated object may shake in the container, or may spill as a result of turning the container over, it is also preferable to make the door opening speed slow.

In particular, when a person that is not used for operation, such as a child, takes the food out, it is preferable from the viewpoint of prevention of danger to make the door opening speed slow. For example, it is more preferable that: a setting button similar to a child safety lock button is provided in the operating unit; and when the door open button and the child safety lock button are pushed simultaneously, the door opens quickly; and when the door open button is pushed alone, the door opens slowly.

As described above, it is desirable that the opening/closing speed of the opening and closing door is set so that it can be changed according to a use condition of a user or a property of the heated object.

In the drawer-type heating cooker in which the sound settings can be changed, the sound settings for the warning sounds can be determined according to a maximum open distance of the opening and closing door. For example, when the maximum open distance is set to be long, the sound settings can be associated with a high warning ability sound. Conversely, when the maximum open distance is set to be short, the sound settings can be associated with a low warning ability sound.

In this drawer-type heating cooker, furthermore, the maximum open distance of the opening and closing door can be set so that it can be changed according to a use condition of a user or a property of the heated object. For example, changing the open distance according to the heated object can eliminate the need for securing unnecessary open distance or time. Also, since the user can set the open distance for the opening and closing door, dangers can be prevented, making it possible to prevent the furniture or the like from being hit.

In this drawer-type heating cooker, it is preferable that a user can further change the sound settings for the warning sounds. As a drawer-type heating cooker, the opening/closing speed and maximum open distance for the opening and closing door can be set in advance. However, for some users, it is preferable that the sound settings can further be changed so that the warning sounds can easily be distinguished.

The drawer-type heating cooker according to the present invention provides the above-mentioned configurations, so it generates warning sounds during opening/closing of the opening and closing door, and during automatic opening of the opening and closing door, attention from people around the heating cooker is called by means of a warning sound according to automatic opening, preventing a person or thing from being unexpectedly hit by the automatically-opening door, and further preventing a person or thing from tumbling over due to such hitting. Also, during automatic closing of the opening and closing door, the heating cooker generates a warning sound according to automatic closing so that a hand or finger, or a thing will not be stuck in the opening and closing door that is closing, preventing such accidents. Furthermore, when the opening and closing door moves as a result of unknowingly touching the door open or close key on the drawer-type heating cooker, people around the heating cooker can immediately recognize such an unexpected movement of the opening and closing door opening or closing by means of a warning sound.

As stated above, according to this drawer-type heating cooker, during opening/closing operation of the opening and closing door, attention to the opening and closing door movement is called from the operating person as well as the other people around the drawer-type heating cooker, allowing the prevention of dangers, such as being hit by the opening and closing door that is opening, or a hand or finger being stuck in the opening and closing door that is closing.

Furthermore, it has the effect of drowning out unfavorable machine noises during opening/closing of the opening and closing door as a result of generating sounds suited to a user's taste during opening/closing.

Also when the opening/closing speed and the maximum open distance can be changed, the sound settings for the warning sounds make it possible to respond to the user's use conditions or the heated object. Furthermore, the sound settings for the warning sounds make it possible to understand and recognize the changing state of the opening/closing of the opening and closing door.

DETAILED DESCRIPTION OF THE PREFERRED EMBODIMENTS

Figure 1:
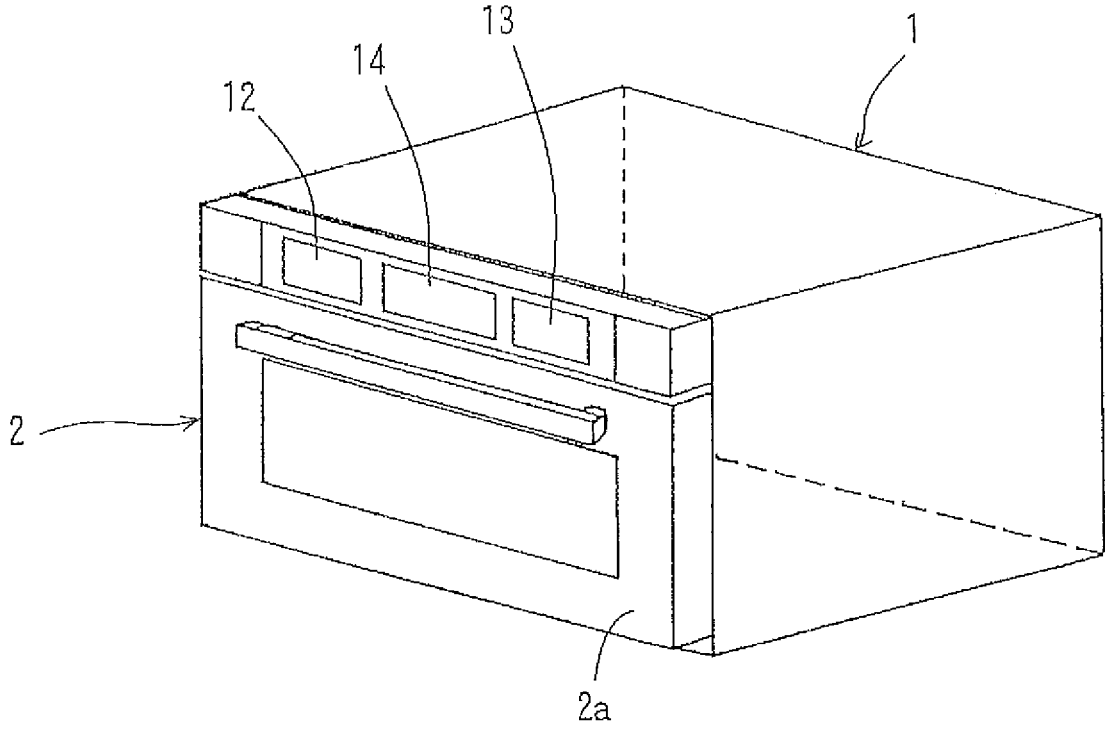
FIG. 1 is a perspective view of an embodiment of a drawer-type heating cooker according to the present invention with its opening and closing door closed.
Figure 2:
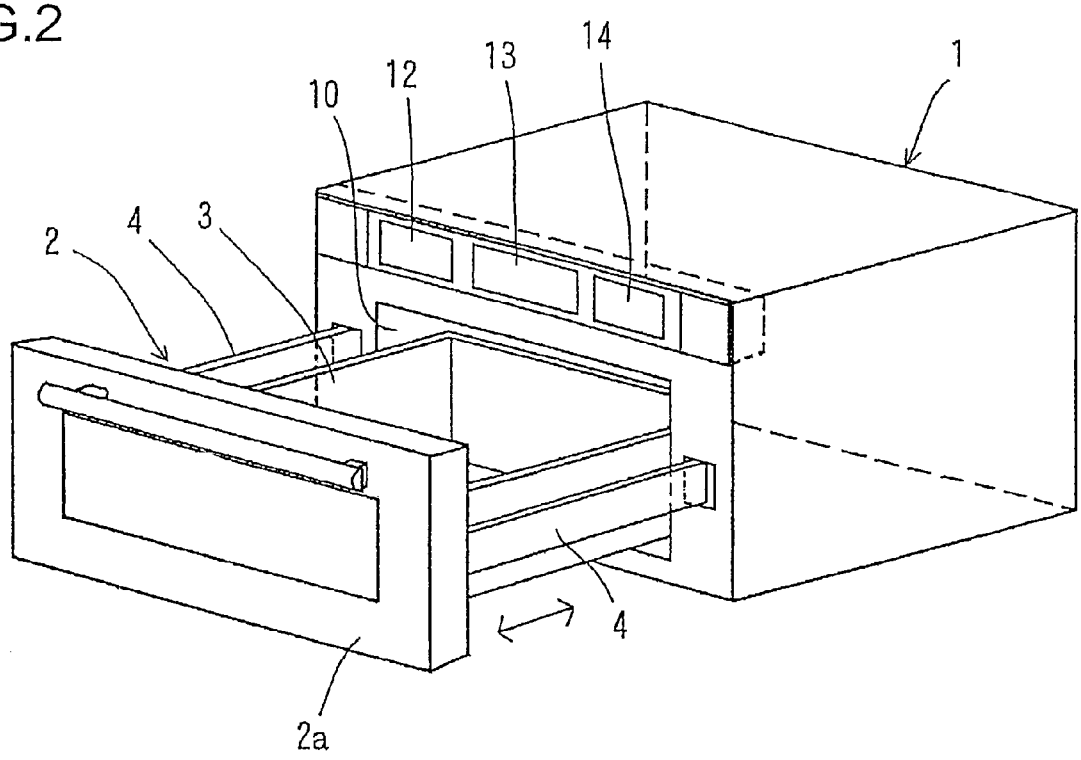
FIG. 2 is a perspective view of the drawer-type heating cooker shown in FIG. 1 with its opening and closing door opened.
Figure 3:
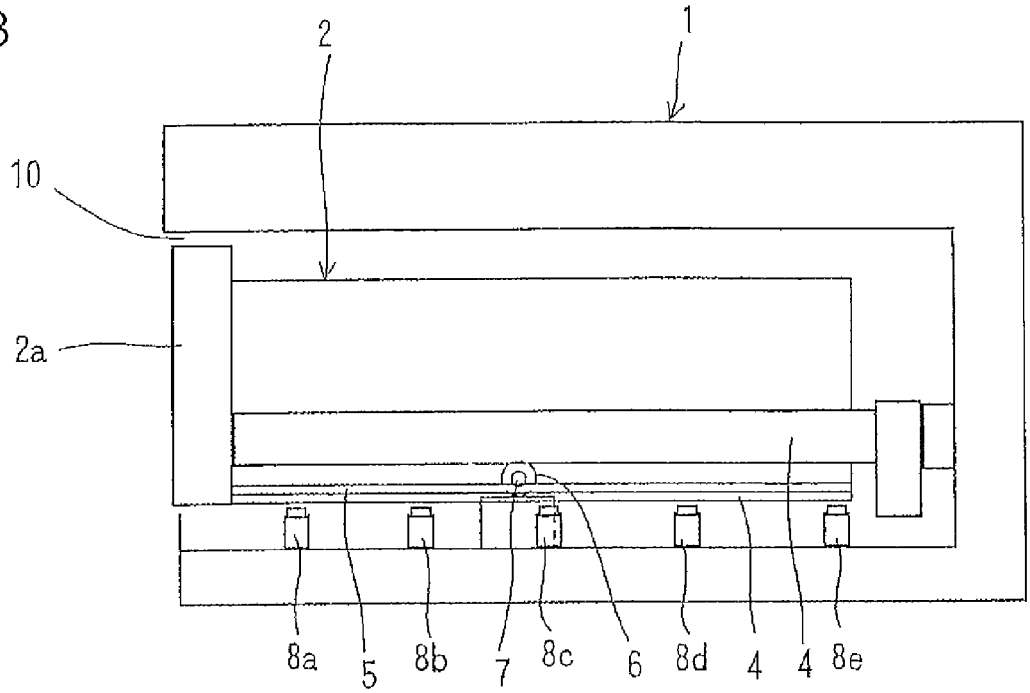
FIG. 3 is a cross-sectional side view of the drawer-type heating cooker shown in FIG. 1.

Hereinafter, embodiments of the drawer-type heating cooker according to the present invention are described based on the attached drawings. FIG. 1 is a perspective view of an embodiment of the drawer-type heating cooker according to the present invention with its opening and closing door closed; FIG. 2 is a perspective view of the drawer-type heating cooker shown in FIG. 1 with its opening and closing door opened; and FIG. 3 is a cross-sectional side view of the drawer-type heating cooker shown in FIG. 1.

As shown in FIGS. 1 and 2, the drawer-type heating cooker shown in FIG. 1 (hereinafter simply referred to as the "heating cooker") includes a cooker body 1, and a drawer body 2 that can be pulled out from the cooker body 1. Inside the cooker body 1, a heating chamber, which the drawer body 2 for placing a heated object to be cooked therein can enter, is formed. The inside of the heating chamber is surrounded by the right and left, upper and lower, and back walls, and on the front surface, an opening portion for pulling out/pushing the drawer body 2 from/into is formed.

The drawer body 2 is disposed in such a manner it can move within the cooker body 1 via slide mechanisms 4, which are described later, so that it is pulled out from the heating chamber of the cooker body 1 to the outside in the direction shown in the arrow, or conversely, it is confined to the heating chamber from the outside. The drawer body 2 includes an opening and closing door (hereinafter abbreviated as the "door") 2*a* for opening/closing the heating chamber, and a heating container 3, to which the door 2*a* is attached, for accommodating a heated object when the heated object is placed therein. The heating container 3 has a front plate connected to the door 2*a*, right and left side plates extending backward from the right and left sides of the front plate, a back plate connected to the side plates at their rear (back) sides, and a bottom plate connected to the side plates and the back plate, and has a container opening portion allowing a heated object to be put in or taken out at its upper portion. In the cooker body 1, a microwave generating device (not shown) is provided around the heating chamber, the microwave generating device including a magnetron that generates microwave and a wave guide tube that transmits the microwave generated by the magnetron. The microwave generated by the magnetron passes through the wave guide tube, and supplied from a power supply port into the heating chamber.

The heating cooker includes slide mechanisms 4, 4 arranged on both the right and left external sides of the heating container 3, and a slide mechanism 4 (see FIG. 3) arranged on the bottom side in order to move the drawer body 2 within the cooker body 1. Each slide mechanism 4, although it is not shown in details, is a nested mechanism including slide rails in which a movable rail is slidable relative to a fixed rail. The drawer body 2 can be moved between the fully-opened position where the heating container 3 is fully pulled out from the heating chamber, and the fully-closed position where the heating container 3 is fully pushed into the heating chamber. When the drawer body 2 is positioned at the fully-closed position, the door 2*a* closes the opening portion 10 of the heating chamber, so the internal space of the heating chamber is sealed by the inner walls of the cooker body 1 and the drawer body 2.

The slide mechanisms 4 are provided in passage boxes formed on the right and left sides and the bottom side of the heating chamber in the cooker body 1, and the fixed rails are attached on the outsides of the heating chamber in the passage boxes, and the movable rails can appear from the passage boxes together with the drawer body 2. The drawer body 2 is supported by the cooker body 1 via the slide mechanisms 4, and can be pulled out from the heating chamber in a stable manner As shown in FIG. 3, in order to drive the drawer body 2 in the opening/closing direction, a rack 5 is secured to the movable rail of the bottom side slide mechanism 4 along the longitudinal direction of the movable rail, and a pinion 7 attached to the output shaft of a drive motor 6 provided in the cooker body 1 engages with the rack 5.

At least any of the slide mechanisms 4 is provided with a mechanism that actuates a full-opening detection switch or full-closing detection switch when the drawer body 2 is moved to the fully-opened position or the fully-closed position, respectively. For full-closing detection, when the drawer body 2 is pushed from the opened state into the full-closed position, an actuating lever provided at the backmost position of the movable rail turns the full-closing detection switch on. Also, as shown in FIG. 3, in the passage box, the cooker body 1 is provided with a plurality of detection switches 8 (8*a* to 8*e*) including the full-closing and full-opening detection switches along the direction of the drawer body 2 being pulled out, at appropriate intervals. As described above, the actuation of the detection switches 8 arranged so that they correspond to the full-opened, intermediate, and full closed positions of the drawer body 2 makes it possible to detect the position of the drawer body 2, and the control of opening/closing the drawer body 2 is performed based on such position information on the door 2*a*.

When the drawer body 2 is pulled out, the actuating lever is left from the full-closing detection switch, and turns the full-closing detection switch off. Accordingly, even during cooking, as well as after cooking, the power supply to the microwave generating device becomes off when the drawer body 2 is opened, making the generation of microwave impossible. The full-closing detection switch can be used as a part of a switch that controls the oscillation and discontinuation of microwave. A user can set how the heating cooker actually performs heating, using other operation switches. Also, a main switch for starting cooking is separately provided. Furthermore, an operation switch (opening and closing door operating unit) 12 for controlling the actuation of the heating cooker including the opening/closing operation of the door 2*a* can be arranged in the cooker body 1 (or door 2*a*).

As described above, the drawer-type heating cooker is a drawer-type heating cooker in which the drawer body 2 allowing a heated object to be placed therein can be pulled out from the cooker body 1 together with the door 2*a*, the opening portion 10 of the heating chamber can be closed by the door 2*a* in a pushed-in state in which the drawer body 2 is housed in the heating chamber in the cooker body 1. A speaker 13 that emits a warning sound, which is described later, during opening/closing of the door 2*a* is provided in the cooker body 1 or the door 2*a*.

Figure 4:
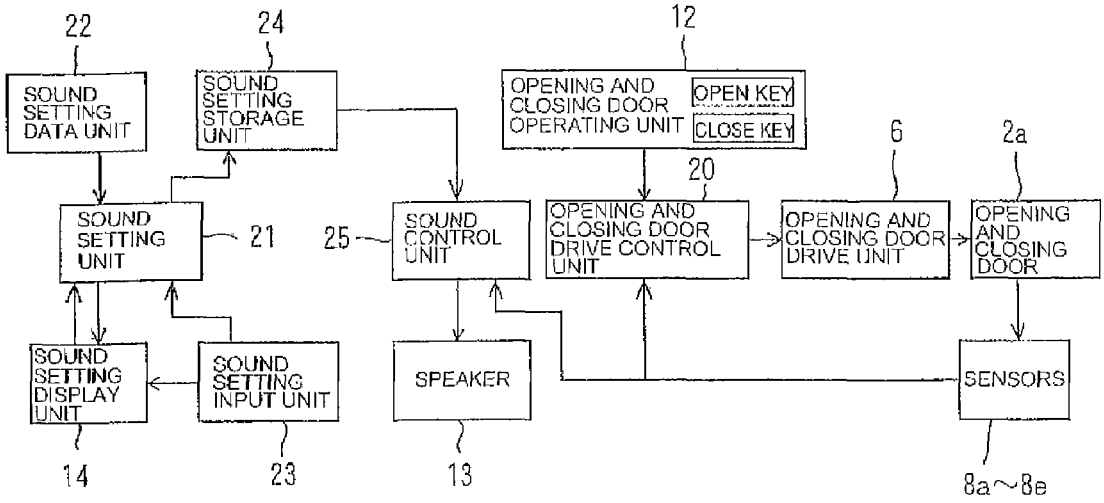
FIG. 4 is a control block diagram relating to the driving of the opening and closing door and warning sounds in a drawer-type heating cooker.

FIG. 4 is a control block diagram relating to the driving of the opening and closing door and warning sounds in the drawer-type heating cooker. An opening and closing door drive control unit 20 constitutes a part of a control unit of the drawer-type heating cooker. The opening and closing door drive control unit 20 puts out a drive control signal to the opening and closing door drive unit (drive motor) 6, and the opening and closing door drive unit (drive motor) 6 provides the door 2*a* with an opening/closing driving force via a transmission mechanism including the pinion 7 and the rack 5 to automatically open or close the door 2*a*. The position and speed of the door 2*a* (which can be detected from the driving rotation of the drive motor or the detecting time interval between the positions to be detected) are constantly detected by the sensors 8*a* to 8*e*, and the detected data is fed back to the opening and closing door drive control unit 20 to control the opening/closing of the door 2*a* with reference to a set speed and position.

A warning sound is set by a sound setting unit 21. In other words, prepared setting data is read from a sound setting data unit 22, and the read data is displayed on a sound setting display unit 14 provided on the front surface of the cooker body 1, and watching that display, a user can set the sound for the warning sound via a sound setting input unit 23 in the form of a dialogue. The sound setting display unit 14 is an ordinary display unit for a heating cooker, and can be a screen displayed when the sound setting is selected from the menu screen.

The sound setting input unit 23 can be a touch panel on the sound setting display unit 14, or a remote controller. The data set by the operation and selection via the sound setting input unit 23 is stored in the sound setting storage unit 24. As described later, the settings for the sound can be made by selecting the pitch, tone, volume or the like of the sound, or setting the levels thereof.

The settings for the sound is stored in the sound setting storage unit 24, and a sound control unit 25 controls the output of the speaker 13 by means of reading the settings from the sound setting storage unit 24. In other words, it decides the pitch, tone, volume and the time consumed for the warning sound. The detected data on the opened/closed position and speed of the door 2*a* is input not only to the opening and closing door drive control unit 20, but also to the sound control unit 25, so the control of warning sound generation is performed in step with the control of opening/closing the door 2*a*.

A sound can be set by selecting a pre-stored warning sound, and furthermore, for a change enhancing the warning ability, selecting methods to be employed from the respective change methods. The set alarm sound is stored in the sound setting storage unit 24, and by means of reading the settings from the sound setting storage unit 24, the sound control unit 25 controls the output of the speaker 13. In other words, it decides the pitch, tone, volume and the time consumed for the warning sound. The detected data on the opened/closed position and speed of the door 2*a* is input not only to the opening/closing drive control unit 20, but also to the sound control unit 25, so the control of warning sound generation is performed in step with the control of opening/closing the door 2*a*.

Since the user's culture, taste and sensitivity can decide how the warning sound is perceived, it is necessary to comply with the basic setting standards for selecting and setting the warning sound. However, for employing it in products, it is preferable to ask plural users for trial use or preview so as to select and set a warning sound whose relation with opening and closing door operation can easily be understood and also whose warning ability can easily be understood.

A method for setting the warning ability of a warning sound and a method for distinguishing warning sounds between door opening and door closing are described referring to simple warning sounds as an example. First, when it is decided that a melody with an ascending tendency is assigned for a warning sound during door opening and a melody with a descending tendency is assigned for a warning sound during door closing, a general user becomes able to easily distinguish the sounds between door opening and door closing in a relatively-short period of time.

It is assumed that an example of a unit melody with an ascending tendency "do, re, mi, re, mi, fa, mi, fa, sol, fa, sol, la, sol, la, si, do" and an example of a unit melody with a descending tendency "do, si, la, si, la, sol, la, sol, fa, sol, fa, mi, fa, mi, re, do" is used for warning sounds. Here, when the note "la" is 880 Hz, they are melodies with repetition of three consecutive tones ascending/descending and the subsequent tone descending/ascending by a whole tone in the known C major scale, the melodies being finally completed by ascending/descending by one octave.

Supposing that the durations of the tones constituting the respective unit melody are all fixed to 0.5 seconds and the tones are played consecutively, if each tone is a quarter note, for example, the tempo will be one with a metronome speed of 120 (M.M.=120) in which 120 quarter notes are generated in one minute. Since the tones are consecutively generated without discontinuity, they are expressed in legato in musical language. Also, the volume is fixed, and no volume changes such as a gradual increase or gradual decrease are made.

If the door opening or door closing operation has not yet finished even when the unit melody is completely played, the unit melody is repeated, and when the door opening or door closing operation has finished, the unit melody finishes after the last-generated tone of the unit melody continues for 1.0 second. In those cases, a change in the door open distance is a change in the number of repetitions of the unit melody, and no changes are made to the unit melody itself.

The above-mentioned tone-ascending warning sound is referred to as an [A01] warning sound, and the tone-descending warning sound is referred to as a [B01] warning sound. If the [A01] warning sound is generated during a door opening operation, and the [B01] warning sound is generated during a door closing operation, it is possible to easily know the start, the middle and the end of the door opening/closing operation without seeing the cooker operation.

Also, when a unit melody is generated, the warning ability given by the warning sound to a user can be enhanced by performing the processes indicated in a to d below as examples:

user have a sense of tension compared to the [A01] warning sound and the [B01] warning sound, so the warning ability is enhanced.

d. Impact: An [A01d] warning sound and [B01d] warning sound with the volume of each tone of the unit melodies increased at the start and then immediately decreased to become close to an impact blow sound make a user have a sense of tension compared to the [A01] warning sound and the [B01] warning sound, so the warning ability is enhanced.

Each of the above-mentioned changes in items a to d can be made alone, but they can also be made by combining two items or more. For example, an [A01abcd] warning sound and [B01 abcd] warning sound in which a, b, c and d are conducted at the same time are possible.

Furthermore, when an [A02] warning sound and a [B02] warning sound, which each use a unit melody in which the three consecutive tones of the respective unit melody ascends/descends not by whole tone, but by half tone, are set for basic warning sounds, a user have a sense of tension compared to the [A01] warning sound and the [B01] warning sound, so the warning ability is enhanced.

Performing processes a to d above on the [A02] warning sound and [B02] warning sound allows the obtainment of an [A02a] warning sound and a [B02a] warning sound to an [A02d] warning sound and a [B02d] warning sound, which have a high warning ability respectively.

TABLE1

Figure 7:
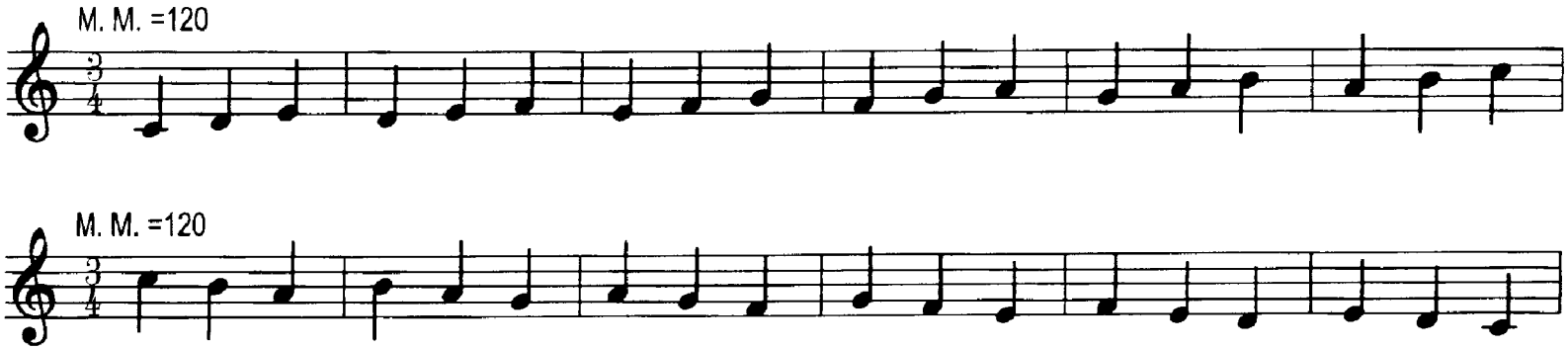
FIG. 7 is a diagram illustrating examples of scores corresponding to unit melodies.

| | | ENHANCEMENT OF THE POSSIBILITY OF WARNING BY MEANS OF PROCESSING THE UNIT MELODY | | | | |
|---|---|---|---|---|---|---|
| OPENING/CLOSING OPERATION | UNIT MELODY | a. SHORTENING | b. GRADUAL VOLUME INCREASE | c. INTERMITTENCE | d. IMPACT | a. + c. |
| DOOR OPENING OPERATION (PULLING-OUT) | [A 0 1] | [A 0 1 a] | [A 0 1 b] | [A 0 1 c] | [A 0 1 d] | [A 0 1 a c] |
| | [A 0 2] | [A 0 2 a] | [A 0 2 b] | [A 0 2 c] | [A 0 2 d] | [A 0 2 a c] |
| DOOR CLOSING OPERATION (PUSHING-IN) | [B 0 1] | [B 0 1 a] | [B 0 1 b] | [B 0 1 c] | [B 0 1 d] | [B 0 1 a c] |
| | [B 0 2] | [B 0 2 a] | [B 0 2 b] | [B 0 2 c] | [B 0 2 d] | [B 0 2 a c] |

a. SHORTENING: THE DURATION OF EACH TONE IS GRADUALLY SHORTENED DURING THE REPETITION OF THE UNIT MELODY.
b. GRADUAL VOLUME INCREASE: THE VOLUME IS GRADUALLY INCREASED DURING THE REPETITION OF THE UNIT MELODY.
c. INTERMITTENCE: THE DURATION OF EACH TONE IS SHORTENED TO INTERMITTENTLY GENERATE THE SOUNDS.
d. IMPACT: THE VOLUME IS SHARPLY DECREASED AFTER THE START OF EACH TONE.

a. Shortening: During the repetition of the unit melodies, an [A01a] warning sound and [B01a] warning sound with their respective tone durations shortened make a user have a sense of tension compared to the [A01] warning sound and the [B01] warning sound, so the warning ability is enhanced.

b. Gradual volume increase: during the repetition of the unit melodies, an [A01b] warning sound and [B01b] warning sound with their volume increased make a user have a sense of tension compared to the [A01] warning sound and the [B01] warning sound, so the warning ability is enhanced.

c. Intermittence: The durations of the respective tones of the unit melodies are shortened, for example, an [A01c] warning sound and [B01c] warning sound with their tone generating duration of 0.5 seconds changed to a set of a tone generating duration of 0.4 seconds and a silent period of 0.1 second, which are staccato expressions in musical language, make a FIG. 7 shows examples of scores corresponding to unit melodies [A01] and [B01].

In other words, warning sounds which can be distinguished between door opening and door closing and which has the warning ability achieved by means of strength and weakness can be set and a selection according to the user's taste can be made possible, by selecting one from N basic melodies from [A01] and [B01] to [AN] and [BN] in the column direction of Table 1 and selecting a method for changing the selected basic melodies from methods such as a, b, c, and d.

Although the above warning sound settings and changes are described as technical methods, in practice, when a warning sound written in the form of scale is played using an electric keyboard that can be operated via a computer and a method as described above is conducted as an expression in music playing, it is easy to make a highly-reproducible trial use and confirmation.

In particular, when playing music on a score, it is easy to make a stepwise frequency change in which one octave is divided into twelve steps, by transposing a unit melody which is initially set in C major to a key such as D major or E flat major. In pitch setting, a user may have discomfort depending on his/her sense of hearing when the pitch is consecutively changed. However, if the pitch change is made so that it can be recognized as a musical transposition, the pitch can be set without bringing discomfort.

The above-described changes and warning ability changes indicate an example of a simple setting method using an extremely-simple scale as the subject. However, more complicated and free melodies and process methods can be employed after trial use and confirmation if they are selected after confirming in trial use that they are easily distinguished between door opening and door closing, and that differences in warning ability can easily be recognized.

Figure 5:
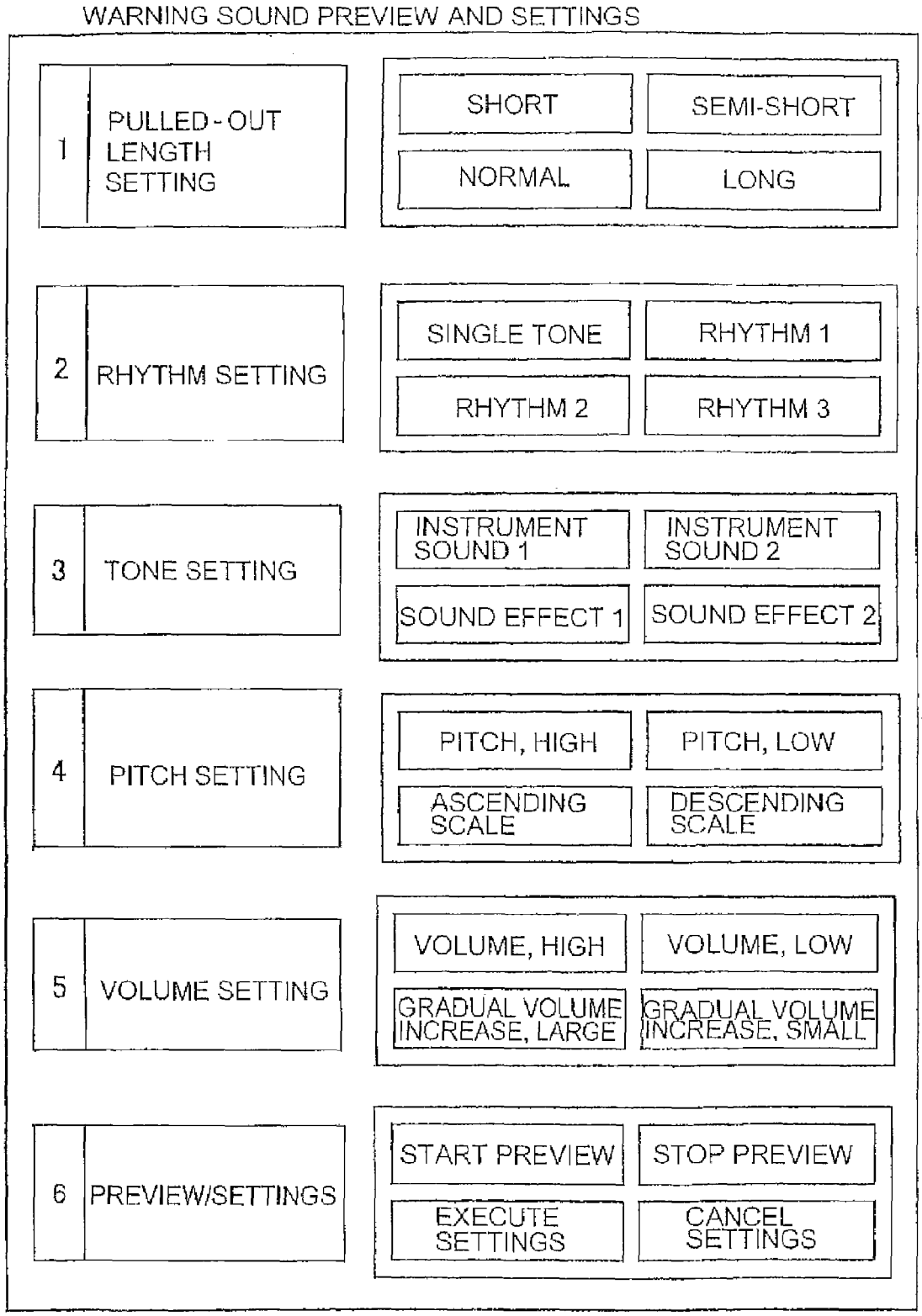
FIG. 5 is a diagram showing an example of an operating unit that performs warning sound preview and setting.

An example of a sound setting operation at the sound setting display unit 14 is shown in FIG. 5. In the item for pulled-out length setting, the length of the drawer pulled out due to opening/closing from its full-closing to its full-opening (it is preferable to determine the length in terms of sections, but not limited to that) is set, and the pitch setting, tone setting, and volume setting can be performed according to the respective pulled-out length. In the rhythm setting, either a single tone repetition, or a rhythm element having a certain kind of rhythm pattern (which is a short one and is repeatedly played) can be selected.

In the pitch setting, the scale, and sound frequency levels or the like can be selected. In the tone setting, the kind of an instrument sound such as a whistle, or the kind of a synthesized sound can be selected. Furthermore, in the volume setting, the volume of a warning sound and a gradual increase or decrease of the volume can be set.

In FIG. 5, a user can preview a warning sound after a sound setting change to choose whether to determine to make the sound setting change, or to cancel the sound setting change and maintain the previous sound settings.

Figure 6A:
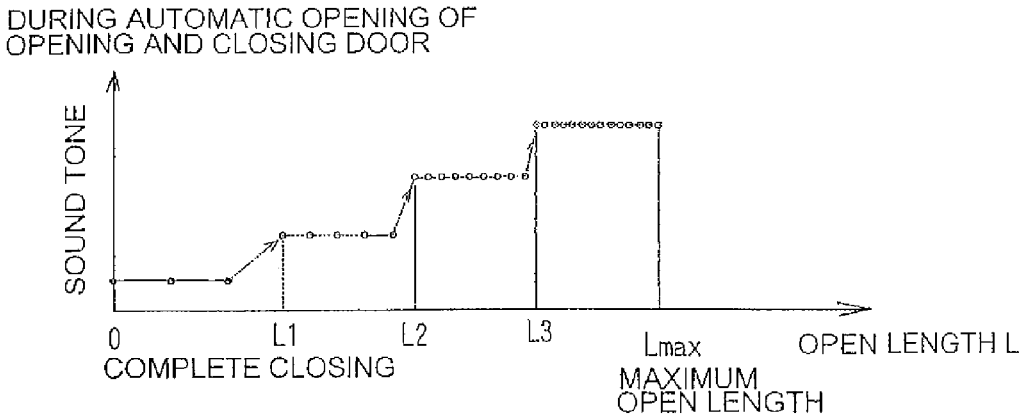
FIG. 6A is a diagram illustrating the status of a warning sound during automatic opening of an opening and closing door.
Figure 6B:
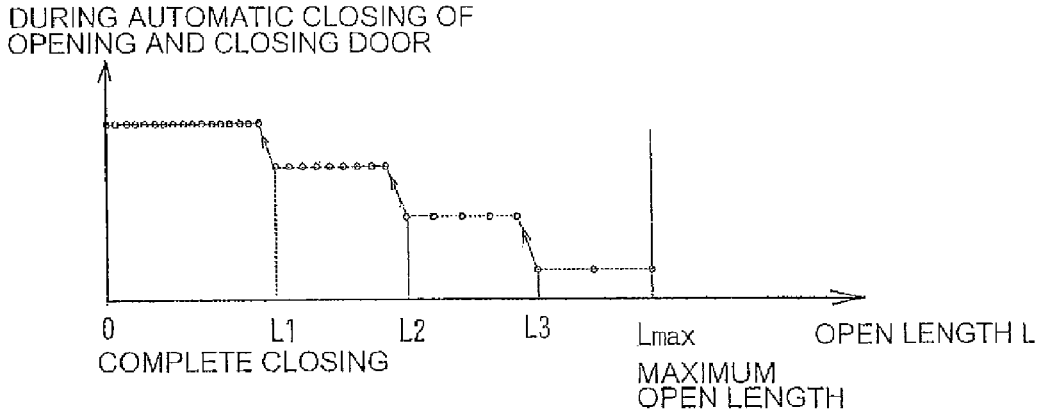
FIG. 6B is a diagram illustrating the status of a warning sound during automatic closing of an opening and closing door.

FIG. 6A shows the status of an actual warning sound during automatic opening of the opening and closing door, and FIG. 6B shows the status of an actual warning sound during automatic closing of the opening and closing door. As shown in FIGS. 6A and 6B, the sound settings for the warning sound can be set according to whether the current opening and closing door operation is a door opening operation or a door closing operation, and also according to the current open distance L in each operation. In other words, as shown in FIG. 6A, during automatic opening, the pitch can be raised as the open distance L is increased by opening the door. As the maximum open distance Lmax is greater, the maximum value of the pitch can also be raised. Meanwhile, as shown in FIG. 6B, during automatic closing, the pitch can be raised as the open distance L becomes shorter by closing the door. In this instance, also, as the maximum open distance Lmax is greater and the open distance becomes closer to the complete closing, the pitch can be raised.

Furthermore, these sound settings can be made according to the opening/closing speed of the opening and closing door, the maximum open distance and the user's use conditions, or the properties of the heated object. For example, it is preferable to set a sound with higher warning ability as the opening/closing speed of the opening and closing door is higher, the maximum open distance is longer, or the required heating output or the size of the heated object is greater.

Alternatively, when a liquid heated object is subject to high-frequency heating in a static condition in a drawer-type heating cooker, a bumping phenomenon in which boiling does not occur even though the temperature of the heated object excesses the boiling point and in which boiling is started by the vibration caused by the opening of the opening and closing door easily occurs, so it is preferable to set a sound with higher warning ability for opening of the opening and closing door, compared to the sound setting for closing of the opening and closing door.

By a user previewing and confirming such sound settings, those settings can be made so that the sounds can easily be recognized as warning sounds, and differences in warning sounds between the operations can easily be recognized.

What is claimed is:

1. A drawer-type heating cooker allowing a drawer body for placing a heated object therein to be pulled out from and pushed into a cooker body, an opening portion of a heating chamber being able to be opened and closed by an opening and closing door, wherein sound settings are made to generate different warning sounds for an opening operation of the opening and closing door and a closing operation of the opening and closing door, and during the opening operation of the opening and closing door and the closing operation of the opening and closing door, the warning sound having the sound setting is generated based on whether there is an opening operation or a closing operation.

2. The drawer-type heating cooker according to claim 1, wherein the sound settings for the warning sounds are determined according to the opening/closing speed during the opening operation of the opening and closing door and the closing operation of the opening and closing door.

3. The drawer-type heating cooker according to claim 2, wherein the opening/closing speed of the opening and closing door is set so that it can be changed according to a use condition of a user or a property of the heated object.

4. The drawer-type heating cooker according to claim 1, wherein the sound settings for the warning sounds are determined according to a maximum open distance of the opening and closing door.

5. The drawer-type heating cooker according to claim 4, wherein the maximum open distance of the opening and closing door is set so that it can be changed according to a use condition of a user or a property of the heated object.

6. The drawer-type heating cooker according to claim 1, wherein a user can further change the sound settings for the warning sounds.

* * * * *